United States Patent [19]

Jahnke

[11] 4,116,872

[45] Sep. 26, 1978

[54] HOT MELT METAL WORKING LUBRICANTS

[75] Inventor: Richard William Jahnke, Mentor-On-The-Lake, Ohio

[73] Assignee: The Lubrizol Corporation, Wickliffe, Ohio

[21] Appl. No.: 766,642

[22] Filed: Feb. 8, 1977

[51] Int. Cl.[2] ..... C10M 1/48; C10M 3/42; C10M 5/24; C10M 7/46

[52] U.S. Cl. ..... 252/32.7 E; 72/42; 252/32.5; 252/56 R; 252/56 S

[58] Field of Search ..... 72/42; 252/56 S, 52 R, 252/32.5, 32.7 E, 56 R

[56] References Cited

U.S. PATENT DOCUMENTS

| | | | |
|---|---|---|---|
| 2,889,281 | 6/1959 | Matuszak et al. | 252/56 S |
| 3,252,909 | 5/1966 | Jenks | 252/56 S |
| 3,526,596 | 9/1970 | Kress et al. | 252/56 S |
| 3,562,159 | 2/1971 | Mastin | 252/32.7 E |
| 3,676,348 | 7/1972 | Unick et al. | 252/54 |
| 3,791,970 | 2/1974 | Tubb | 252/12 |
| 3,871,837 | 3/1975 | Bedague et al. | 252/56S |
| 3,875,069 | 4/1975 | Worschech et al. | 252/56 S |
| 3,912,642 | 10/1975 | Starrwold et al. | 252/56 S |

FOREIGN PATENT DOCUMENTS

| | | | |
|---|---|---|---|
| 2,545,500 | 4/1976 | Fed. Rep. of Germany | 252/32.7 E |

*Primary Examiner*—Delbert E. Gantz
*Assistant Examiner*—Irving Vaughn
*Attorney, Agent, or Firm*—James W. Adams, Jr.; William H. Pittman

[57] ABSTRACT

Metal working operations, especially drawing, are facilitated by applying to the metal a composition which provides lubricity thereto and which melts within the range of about 30°-100° C. The composition comprises at least one neutral ester, and preferably a mixture of esters, prepared from polyalkylene glycols and saturated aliphatic alcohols having at least about 10 carbon atoms, and $C_{12-25}$ aliphatic monocarboxylic acids and $C_{4-20}$ aliphatic polycarboxylic acids. The preferred ester mixtures are prepared from polyethylene glycols, $C_{14-20}$ predominantly straight chain alkanols, stearic acid and adipic, azelaic or sebacic acid. Optional ingredients include phosphorus acid salts and anti-oxidants. The composition may be applied in liquid form and solidifies on cooling to normal ambient and storage temperatures.

33 Claims, No Drawings

HOT MELT METAL WORKING LUBRICANTS

This invention relates to metal working operations. More particularly, it relates to compositions useful as lubricants and methods for lubricating metal during such operations, and to metal workpieces so lubricated.

Metal working operations, for example, rolling, forging, hot-pressing, blanking, bending, stamping, drawing, cutting, punching, spinning and the like generally employ a lubricant to facilitate the same. Lubricants greatly improve these operations in that they can reduce the power required for the operation, prevent sticking and decrease wear of dies, cutting bits and the like. In addition, they frequently provide rust inhibiting properties to the metal being treated.

Since it is conventional to subject the metal to various chemical treatments (such as the application of conversion coating solutions) after working, a cleaning operation is necessary between the working step and the chemical treatment step. In addition to the above properties, therefore, it is preferred that the working lubricant be easily removable from the metal surface by ordinary cleaning compositions.

Heretofore, the lubricants applied for the above purposes have ordinarily been liquids. The equipment used for the application of such liquids is often expensive to maintain and inconvenient to use. In addition, a dry-off oven is usually required to remove the water or solvent carrier from the liquid composition, which also greatly adds to the capital costs and operating and maintenance expenses of the method. Difficulties are also often encountered in automatic feeding of metal blanks and otherwise handling the metal because the liquid compositions which are normally applied to the metal make it wet and slippery and consequently difficult to handle.

A principal object of the present invention, therefore, is to provide an improved metal working method.

A further object is to provide a method using lubricants which impart to the metal being worked a unique combination of properties including lubricity, corrosion resistance, extreme pressure properties and protection against wear of working parts, and which in addition are relatively easy to remove from the surface of the metal by cleaning after the working operation is completed.

A further object is to provide novel compositions for use in the improved method.

Other objects will in part be obvious and will in part appear hereinafter.

According to this invention, the above objects are fulfilled by applying to the metal to be worked a composition which provides lubricity thereto, which melts within the range of about 30°–100° C., and which comprises at least one neutral ester defined as follows:

I. The alcohol moieties are derived from (A) a polyalkylene glycol containing about 20–50 polyoxyalkylene units, or a mixture thereof with (B) at least one saturated aliphatic alcohol having at least about 10 carbon atoms;

II. The acid moieties are derived from (C) at least one $C_{12-25}$ aliphatic monocarboxylic acid, or a mixture thereof with (D) at least one $C_{4-20}$ aliphatic polycarboxylic acid. Preferably, the composition melts to form a readily flowable liquid which is capable of easy and efficient application to the metal surface. One advantage of such a composition (sometimes referred to hereinafter as the "hot melt composition") is that metals coated therewith are easier to handle under normal storage conditions than metals coated with previously known lubricants.

The principal necessary characteristic of the hot melt composition is its capability of providing lubricity to the metal surface. For this purpose, lubricity may be defined in many ways which are well known to those skilled in the art, and in terms of a number of test methods which, in one way or another, simulate metal working operations. For the purpose of this invention, a composition is deemed to provide lubricity to a metal workpiece if its use results in a deviation of 100 foot-pounds or less when tested by the following method:

A cold-rolled steel strip, 2 inches × 13½ inches, is drawn between two dies in an Instron Universal Tester, Model TT-C. Prior to drawing, the edges of the strip are deburred and the strip is vapor degreased and wiped with a clean cloth. It is then coated uniformly with a drawing lubricant and mounted in the testing machine. The dies are tightened by means of a torque wrench set at 40 foot-pounds torque and the strip is pulled through the die for two inches at the rate of five inches per minute. The force or "load", in foot-pounds, required to pull the strip through the die, and the deviation from a uniform load, are recorded on a chart.

The hot melt composition melts in the range of 30°–100° C., as previously indicated. Thus, it is solid at normal ambient temperature (e.g., about 20°–30° C.) and pressure. The preferred melting range is 35°–70° C., with 38°–55 ° C. being particularly desirable. When melted, the composition preferably forms a readily flowable liquid.

The principal ingredient of the hot melt composition is at least one substantially neutral ester (i.e., one in which substantially all of the acid groups are esterified) as defined hereinabove. The alcohols and acids from which the ester is derived are more fully identified as follows:

Alcohol A is a polyalkylene glycol, usually a polyethylene or polypropylene glycol and preferably the former, containing about 20–50 polyalkylene units. Such polyalkylene glycols are normally available as commercial mixtures such as the "Carbowax" polyethylene glycols sold by Union Carbide.

Alcohol B is at least one saturated aliphatic alcohol having at least about 10 carbon atoms. Examples are decanol, dodecanol, tetradecanol, stearyl alcohol, eicosanol, and commercial mixtures of such alcohols, as well as corresponding diols, triols, etc. Preferred are $C_{14-20}$ alcohols, especially alkanols (that is, saturated monohydroxy alcohols) and more especially predominantly straight-chain alkanols.

Acid C is at least one $C_{12-25}$ aliphatic monocarboxylic acid such as lauric, myristic, palmitic, stearic, eicosanoic, oleic or linoleic acid. Mixtures of such acids are also suitable. The preferred acid is stearic acid.

Acid D is at least one $C_{4-20}$ aliphatic polycarboxylic acid; examples are maleic, fumaric, succinic, adipic, glutaric, pimelic, sebacic, azelaic, suberic and citric acids, as well as mixtures thereof. The preferred polycarboxylic acids are dicarboxylic and especially adipic, azelaic and sebacic acids.

A number of esters and ester mixtures are suitable for use according to this invention. For example, esters of alcohol A and acid C are useful; an example is the monostearate of a polyethylene glycol containing an average of about 22–48 oxyethylene units per molecule. The preferred ester compositions, however, contain a plurality of alcohol and acid moieties. Thus, they may comprise a mixture of at least one ester of alcohol A and acid C and at least one ester of alcohol B and acid D, typically containing about 5–95% by weight of the latter.

Especially preferred are mixtures of neutral esters of alcohols A and B and acids C and D, and compositions comprising such mixtures are within the scope of this invention. They are conveniently prepared by simply reacting the alcohol mixture with the acid mixture, typically in the presence of a strong acid as catalyst. Most often, the alcohol mixture contains about 2–4 equivalents of A per equivalent of B and the acid mixture contains about 2–4 equivalents of C per equivalent of D. (The equivalent weight of an alcohol, for the purposes of this invention, is its molecular weight divided by the number of hydroxy groups per molecule and may be determined analytically, especially for polyalkylene glycols. The equivalent weight of a carboxylic acid is its molecular weight divided by the number of carboxy groups per molecule.)

The preferred hot melt compositions contain, in addition to the esters described hereinabove, at least one agent to improve extreme pressure properties. The most suitable extreme pressure agents are phosphorus acid salts of the formula

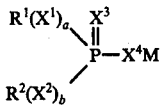

wherein M is a Group I metal, a Group II metal, aluminum, tin, cobalt, lead, molybdenum, manganese, nickel or ammonium; each of $R^1$ and $R^2$ is a hydrocarbon-based radical; each of $X^1$, $X^2$, $X^3$ and $X^4$ is oxygen or sulfur; and each of *a* and *b* is 0 or 1.

In the above formula, each of $R^1$ and $R^2$ is a hydrocarbon-based radical. As used herein, the term "hydrocarbon-based radical" denotes a radical having predominantly hydrocarbon character within the context of this invention. Such radicals include the following:

(1) Hydrocarbon radicals, which may be aliphatic (e.g., alkyl or alkenyl), alicyclic (e.g., cycloalkyl or cycloalkenyl), aromatic, aliphatic- and alicyclic-substituted aromatic, aromatic-substituted aliphatic and alicyclic, and the like.

(2) Substituted hydrocarbon radicals, that is, radicals containing non-hydrocarbon substituents which, in the context of this invention, do not alter the predominantly hydrocarbon character of the radical. Suitable substituents of this type will be apparent to those skilled in the art.

(3) Hetero radicals; that is, radicals which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based radical.

The hydrocarbon-based radicals in the phosphorus acid salt are ordinarily free from acetylenic and usually also from ethylenic unsaturation and have no more than about 30 carbon atoms, desirably no more than about 12 carbon atoms. They are usually hydrocarbon radicals such as methyl, ethyl, propyl, butyl, amyl, hexyl, octyl, decyl, dodecyl, vinyl, decenyl, cyclohexyl, phenyl and the like, all isomers thereof being included. A particular preference is expressed for compounds in which $R^1$ and $R^2$ are lower alkyl radicals, the word "lower" denoting a radical containing not more than 7 carbon atoms.

It will be apparent that the phosphorus acids from which the salts are derived include dialkylphosphoric acids, dialkylphosphinic acids, and thio derivatives of such acids. Preferred are the salts in which $X^3$ and $X^4$ are each sulfur and especially salts of phosphorodithioic acids; that is, salts in which *a* and *b* are each 1 and $X^1$ and $X^2$ are each oxygen. In the above-defined salts, M may be any of the metals previously enumerated or ammonium; the latter term includes substituted ammonium salts (i.e., amine salts). M is preferably zinc or lead, especially zinc.

The hot melt composition most often contains up to about 25% of the phosphorus acid salts as an optional ingredient. It is also within the scope of this invention to incorporate other known additives in minor amounts (typically about 0.01–5.0% by weight) into the hot melt composition. Especially preferred other additives are antioxidants, typically hindered phenols; such materials are well known in the art. Other suitable additives useful in these proportions include:

Surfactants, usually nonionic surfactants such as oxyalkylated phenols and the like.

Auxiliary extreme pressure agents such as chlorinated waxes, sulfurized hydrocarbons, sulfurized esters, etc.

Corrosion and wear inhibiting agents, and auxiliary rust inhibiting agents.

Friction modifying agents, of which the following are illustrative: Alkyl or alkenyl phosphates or phosphites in which the alkyl or alkenyl group contains about 10–40 carbon atoms, and metal salts thereof, especially zinc salts; $C_{10-20}$ fatty acid amides; $C_{10-20}$ alkyl amines, especially tallow amines, and ethoxylated derivatives thereof; salts of such amines with acids such as boric acid or phosphoric acid which have been partially esterified as noted above; $C_{10-20}$ alkyl-substituted imidazolines and similar nitrogen heterocycles; sulfurized derivatives of sperm oil and other fatty oils; basic barium or calcium salts of such oils or of amine-formaldehyde condensates, especially those derived from tallow amines such as described above; and gels derived from basic alkaline earth metal sulfonates.

Melting point modifiers, typically relatively low melting point esters such as dioctyl phthalate.

The invention also contemplates the use of hot melt lubricants containing waxes and waxy polymers, such as crystalline (including microcrystalline) and non-crystalline hydrocarbon waxes, hydroxylated hydrocarbon waxes, petrolatum, and low molecular weight olefin polymers, especially the polyethylenes sold as "Bareco Polywaxes" by Petrolite Corporation. Such waxes or polymers are typically present in amounts of about 0.25–1.0 part by weight per part of ester.

The hot melt composition may be prepared by intimately blending the ingredients thereof, preferably in the liquid state, if more than one ingredient is involved. It may sometimes be preferable to employ a substantially inert liquid diluent to insure intimate blending. By "substantially inert" is meant a diluent which does not undergo any appreciable reaction with the ingredients of the composition under the conditions of blending. Preferred as diluents are liquids which are solvents for the ingredients being blended; suitable solvents will be apparent to those skilled in the art and preferably comprise non-polar liquids such as benzene, toluene, xylene, chlorobenzene and the like. After blending is complete, the diluent is preferably removed, typically by evaporation.

It is also within the scope of the invention to incorporate a small particle size, pigment-type particulate solid in the hot melt lubricant to increase lubricity at temperatures above the melting point thereof. Suitable in this respect are such pigments as rutile titanium dioxide, anatase titanium dioxide, zinc oxide, leaded zinc oxide, zinc sulfide, lead titanate, antimony oxide, zirconium oxide, white lead, basic lead silicate, lithopone, titanated lithopone, titanium-barium pigment, titanium-calcium pigment, titanium-magnesium pigment, calcium carbonate, gilders whiting talc, barytes, magnesium silicate, aluminum silicates, diatomaceous earth, china clay, Asbestine, silica and mica. Calcium carbonate is especially preferred. The amount of such pigment is typically about 0.1–0.2 part by weight per part of ester.

In the following table are listed typical hot melt compositions suitable for use in the method of this invention.

| Ingredient | Parts by weight A | B | C | D |
|---|---|---|---|---|
| Neutral adipic acid ester of commercial mixture of predominantly straight-chain $C_{14-18}$ 1-alkanols* | 10 | — | — | — |
| Neutral azelaic acid ester of commercial mixture of predominantly straight-chain $C_{16-18}$ 1-alkanols* | — | 8.5 | — | — |
| Stearic acid ester of "Carbowax 1540", a polyethylene glycol containing an average of 22–48 oxyethylene units per molecule | 90 | 76.5 | — | — |
| Ester mixture prepared from 0.75 equivalent of "Carbowax 1540", 0.25 equivalent of commercial mixture of predominantly straight-chain $C_{14-18}$ 1-alkanols*, 0.75 equivalent of stearic acid and 0.25 equivalent of adipic acid | — | — | 100 | 90 |
| Zinc salt of a mixture of isobutyl- and primary amylphosphorodithioic acids | — | 15 | — | 10 |

*Available from Procter & Gamble

Any metal to be worked may be treated according to the method of this invention; examples are ferrous metals, aluminum, copper, magnesium, titanium, zinc and manganese as well as alloys thereof and alloys containing other elements such as silicon.

The method of this invention includes any method by which a metal workpiece may be coated with the hot melt composition prior to or concurrently with the working operation. For example, a cutting blade or drawing die may be coated with the composition which is then transferred to the workpiece by contact. More usually, however, the workpiece is coated with the hot melt composition before the working operation. Thus, this invention also contemplates a metal workpiece having on its surface a film of the hot melt composition, whether in solid or liquid form. The hot melt composition will ordinarily form a continuous film over the entire surface of the workpiece. However, it is also within the scope of this invention to form a film on less than the entire surface of the workpiece.

The physical state of the hot melt composition during application to the metal surface is not critical. Thus, it may be applied as a solid (as by rubbing) or as a liquid (as by brushing, spraying, dipping, flooding, roller coating, reverse roller coating or the like). For ease and convenience of application, it is preferably applied in the liquid state, and when this is done the metal may be subsequently cooled whereupon the hot melt composition solidifies, or it may be passed directly to the metal working operation while the composition is in the liquid state. One of the advantages of this invention, however, is that the hot melt composition solidifies to form a solid, non-blocking, non-slippery film on the metal workpiece, thus permitting convenient and safe material handling at reduced cost.

The surface temperature of the metal at the time the hot melt composition is applied may vary, for example, from normal ambient temperature to just below the decomposition temperature thereof. Factors which will influence or determine the temperature of the metal at the time the composition is applied include processes which the metal is subjected to prior or subsequent to application of the composition, the melting point of the composition, and the temperature thereof at the time of application. Using the hot melt compositions described hereinabove, metal surface temperatures of about 20°–125° C. at the time of application have been found particularly useful. The temperature of the hot melt composition should be higher than its melting temperature (preferably at least 10° C. higher and usually about 20°–40° C. higher) at the time of application for ease of flow and uniform dispersion of the composition onto the metal and coverage thereby.

The melted hot melt composition may be applied to the metal in a minimum of space utilizing existing equipment such as coilers used in steel mills prior to coiling, and because it quickly solidifies at ambient temperatures and becomes dry, non-blocking and relatively non-slippery, standard handling equipment such as lifting and feeding rollers. Stackers and so on may also be used. The use of the hot melt composition also eliminates the need for a dry-off oven since there is no water or solvent to remove.

What is claimed is:

1. A method for lubricating metal during working thereof which comprises applying to said metal a lubricating composition which provides lubricity thereto, said composition melting within the range of about 30°–100° C. and comprising at least one substantially neutral ester defined as follows:

I. The alcohol moieties are derived from (A) a polyalkylene glycol containing about 20–50 polyoxyalkylene units, or a mixture thereof with (B) at least one saturated aliphatic alcohol having at least about 10 carbon atoms;

II. The acid moieties are derived from (C) at least one $C_{12-25}$ aliphatic monocarboxylic acid, or a mixture thereof with (D) at least one $C_{4-20}$ aliphatic polycarboxylic acid.

2. A method according to claim 1 wherein the lubricating composition melts within the range of about 35°–70° C.

3. A method according to claim 2 wherein the ester is at least one ester of alcohol A and acid C.

4. A method according to claim 2 wherein the ester is a mixture of at least one ester of alcohol A and acid C and at least one ester of alcohol B and acid D, the latter ester comprising about 5–95% by weight of said mixture.

5. A method according to claim 4 wherein A is a polyethylene glycol containing an average of 22–48 oxyethylene units, B is a $C_{14-20}$ predominantly straight-chain alkanol or commercial mixture of such alkanols, C is an alkanoic acid and D is at least one of adipic, azelaic and sebacic acids.

6. A method according to claim 5 wherein C is stearic acid.

7. A method according to claim 6 wherein the working comprises drawing.

8. A method according to claim 2 wherein the ester is a mixture prepared by reacting a mixture of alcohols A and B with a mixture of acids C and D.

9. A method according to claim 8 wherein about 2–4 equivalents of A are present per equivalent of B in the alcohol mixture, and about 2–4 equivalents of C are present per equivalent of D in the acid mixture.

10. A method according to claim 9 wherein A is a polyethylene glycol containing an average of 22–48 oxyethylene units, B is a $C_{14-20}$ predominantly straight-chain alkanol or commercial mixture of such alkanols, C is an alkanoic acid and D is at least one of adipic, azelaic and sebacic acids.

11. A method according to claim 10 wherein C is stearic acid.

12. A method according to claim 11 wherein the working comprises drawing.

13. A method according to claim 2 wherein the composition additionally contains a phosphorus acid salt having the formula

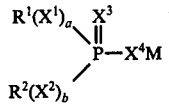

wherein M is a Group I metal, a Group II metal, aluminum, tin, cobalt, lead, molybdenum, manganese, nickel or ammonium; each of $R^1$ and $R^2$ is a hydrocarbon-based radical; each of $X^1$, $X^2$, $X^3$ and $X^4$ is oxygen or sulfur; and each of *a* and *b* is 0 or 1.

14. A method according to claim 13 wherein M is zinc; each of $R^1$ and $R^2$ is a lower alkyl radical; $X^1$ and $X^2$ are oxygen; $X^3$ and $X^4$ are sulfur; and *a* and *b* are each 1.

15. A method according to claim 14 wherein the working comprises drawing.

16. A composition which melts within the range of about 30°–100° C. and which provides lubricity to metal surfaces, said composition comprising a mixture of substantially neutral esters defined as follows:

I. The alcohol moieties are derived from (A) a polyalkylene glycol containing about 20–50 polyoxyalkylene units and (B) at least one saturated aliphatic alcohol having at least about 10 carbon atoms;

II. The acid moieties are derived from (C) at least one $C_{12-25}$ aliphatic monocarboxylic acid and (D) at least one $C_{4-20}$ aliphatic polycarboxylic acid.

17. A composition according to claim 16 which melts within the range of about 35°–70° C.

18. A composition according to claim 17 wherein the ester is a mixture of at least one ester of alcohol A and acid C and at least one ester of alcohol B and acid D, the latter ester comprising about 5–95% by weight of said mixture.

19. A composition according to claim 18 wherein A is a polyethylene glycol containing an average of 22–48 oxyethylene units, B is a $C_{14-20}$ predominantly straight-chain alkanol or commercial mixture of such alkanols, C is an alkanoic acid and D is at least one of adipic, azelaic and sebacic acids.

20. A composition according to claim 19 wherein C is stearic acid.

21. A composition according to claim 17 wherein the ester is a mixture prepared by reacting a mixture of alcohols A and B with a mixture of acids C and D.

22. A composition according to claim 21 wherein about 2–4 equivalents of A are present per equivalent of B in the alcohol mixture, and about 2–4 equivalents of C are present per equivalent of D in the acid mixture.

23. A composition according to claim 22 wherein A is a polyethylene glycol containing an average of 22–48 oxyethylene units, B is a $C_{14-20}$ predominantly straight-chain alkanol or commercial mixture of such alkanols, C is an alkanoic acid and D is at least one of adipic, azelaic and sebacic acids.

24. A composition according to claim 23 wherein C is stearic acid.

25. A composition according to claim 16 which additionally contains at least one phosphorus acid salt having the formula

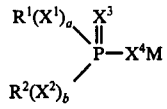

wherein M is a Group I metal, a Group II metal, aluminum, tin, cobalt, lead, molybdenum, manganese, nickel or ammonium; each of $R^1$ and $R^2$ is a hydrocarbon-based radical; each of $X^1$, $X^2$, $X^3$ and $X^4$ is oxygen or sulfur; and each of *a* and *b* is 0 or 1.

26. A composition according to claim 25 wherein M is zinc; each of $R^1$ and $R^2$ is a lower alkyl radical; $X^1$ and $X^2$ are oxygen; $X^3$ and $X^4$ are sulfur; and *a* and *b* are each 1.

27. A composition according to claim 16 which additionally contains an antioxidant.

28. A composition according to claim 18 which additionally contains an antioxidant.

29. A composition according to claim 20 which additionally contains an antioxidant.

30. A composition according to claim 21 which additionally contains an antioxidant.

31. A composition according to claim 23 which additionally contains an antioxidant.

32. A composition according to claim 24 which additionally contains an antioxidant.

33. A composition according to claim 26 which additionally contains an antioxidant.

* * * * *